US005921543A

United States Patent [19]

Becker et al.

[11] Patent Number: 5,921,543

[45] Date of Patent: Jul. 13, 1999

[54] WEIGHT ASSEMBLY FOR AN ENVELOPE FEEDER

[75] Inventors: Freidbert R. Becker; Christopher G. Chee; William J. Thornhiill, all of Lexington, Ky.

[73] Assignee: Lexmark International, Inc., Lexington, Ky.

[21] Appl. No.: 08/852,371

[22] Filed: May 7, 1997

[51] Int. Cl.[6] ..... B65H 1/08; G07F 11/16

[52] U.S. Cl. ..... 271/160; 221/226

[58] Field of Search ..... 271/23, 24, 25, 271/160, 165, 167, 169; 221/226, 227, 213, 279; 211/51

[56] References Cited

U.S. PATENT DOCUMENTS

| | | | |
|---|---|---|---|
| 1,877,842 | 9/1932 | Gay . | |
| 3,635,465 | 1/1972 | Beery | 271/41 |
| 3,892,309 | 7/1975 | Coffey et al. | 211/51 X |
| 3,961,785 | 6/1976 | Gall | 271/119 |
| 4,681,229 | 7/1987 | Uesaka et al. | 209/534 |
| 4,753,369 | 6/1988 | Morrison | 221/56 X |
| 5,004,218 | 4/1991 | Sardano et al. | 271/35 |
| 5,116,034 | 5/1992 | Trask et al. | 271/2 |
| 5,192,069 | 3/1993 | Seymour et al. | 271/35 |
| 5,230,503 | 7/1993 | Saito et al. | 271/121 |
| 5,441,250 | 8/1995 | Kameyama et al. | 271/121 |
| 5,443,251 | 8/1995 | Kan et al. | 271/24 X |
| 5,611,456 | 3/1997 | Kasper | 221/213 X |

FOREIGN PATENT DOCUMENTS

| | | | |
|---|---|---|---|
| 52818 | 2/1890 | Germany | 221/226 |

*Primary Examiner*—William E. Terrell
*Assistant Examiner*—Gene O. Crawford
*Attorney, Agent, or Firm*—John A. Brady

[57] ABSTRACT

An envelope feeder has a movable weight with a relatively large surface area adjacent one of two substantially parallel side walls of the envelope feeder. The weight has gears on opposite ends of a rotatably mounted shaft on which the weight is pivotally supported. The gears cooperate with racks in the two side walls to allow up and down motion of the weight while the shaft stays parallel to the floor. Thus, the position of the movable weight is never skewed. The side wall, which is remote from the relatively large surface area of the movable weight, has a limiter extending therefrom towards the other wall. The limiter acts only on envelopes exceeding a predetermined width to limit the height of a stack of such envelopes so that the power of the envelope advancing motor for feeding each envelope from the bottom of the stack is not exceeded.

4 Claims, 4 Drawing Sheets

WEIGHT ASSEMBLY FOR AN ENVELOPE FEEDER

FIELD OF THE INVENTION

This invention relates to a weight assembly resting on top of a stack of envelopes in an envelope feeder and, more particularly, to a weight assembly for an envelope feeder in which the weight assembly has its envelope engaging surface is supported substantially parallel to the floor of the envelope feeder which also has a limiter for limiting the height of a stack of envelopes when the envelopes exceed a predetermined minimum width.

BACKGROUND OF THE INVENTION

When feeding envelopes from the bottom of a stack of the envelopes, a weight must be placed on top of the stack to enable driving of the last few envelopes of the stack. One prior arrangement has placed a weight on the top envelope of the stack but has not constrained it. Another prior arrangement used a weight conforming to the top envelope and moved in a vertical path. Still another prior arrangement moved a weight on an arc while maintaining the envelope engaging surface of the weight substantially parallel to the floor of the envelope feeder.

The weight assembly of the present invention is an improvement of the prior arrangements in that the weight is constrained while having its envelope engaging surface remain substantially parallel to the floor of the envelope feeder. By constraining the weight so that its envelope engaging surface is substantially parallel to the floor of the envelope feeder at any vertical position of the weight, the weight engages the uppermost envelope in the stack of envelopes at its highest point. Thus, if an envelope is curled or twisted so as to not be flat, the constrained weight provides more force on the highest point of the top envelope of the stack; this tends to push that point downwardly.

Since the curled or twisted portion of the envelope is at the highest point of the envelope to be fed, this curling or twisting of the envelope makes it more difficult to feed it into separating rollers, which are employed to feed only the lowermost envelope. However, by maintaining the constrained weight substantially parallel to the floor of the envelope feeder, particularly adjacent the separating rollers, this problem is significantly avoided.

An object of this invention is to provide an envelope feeder having a weight for engaging the top of a stack of envelopes in which the weight is maintained in a desired orientation at all times while the weight is freely movable along a controlled vertical path.

Another object of this invention is to provide an envelope feeder in which the height of the stack of envelopes is limited when the width of the envelopes exceeds a predetermined minimum.

Other objects of this invention will be readily perceived from the following description, claims, and drawings.

BRIEF DESCRIPTION OF THE DRAWINGS

The attached drawings illustrate a preferred embodiment of the invention, in which.

DETAILED DESCRIPTION OF PREFERRED EMBODIMENT

Figure 1:
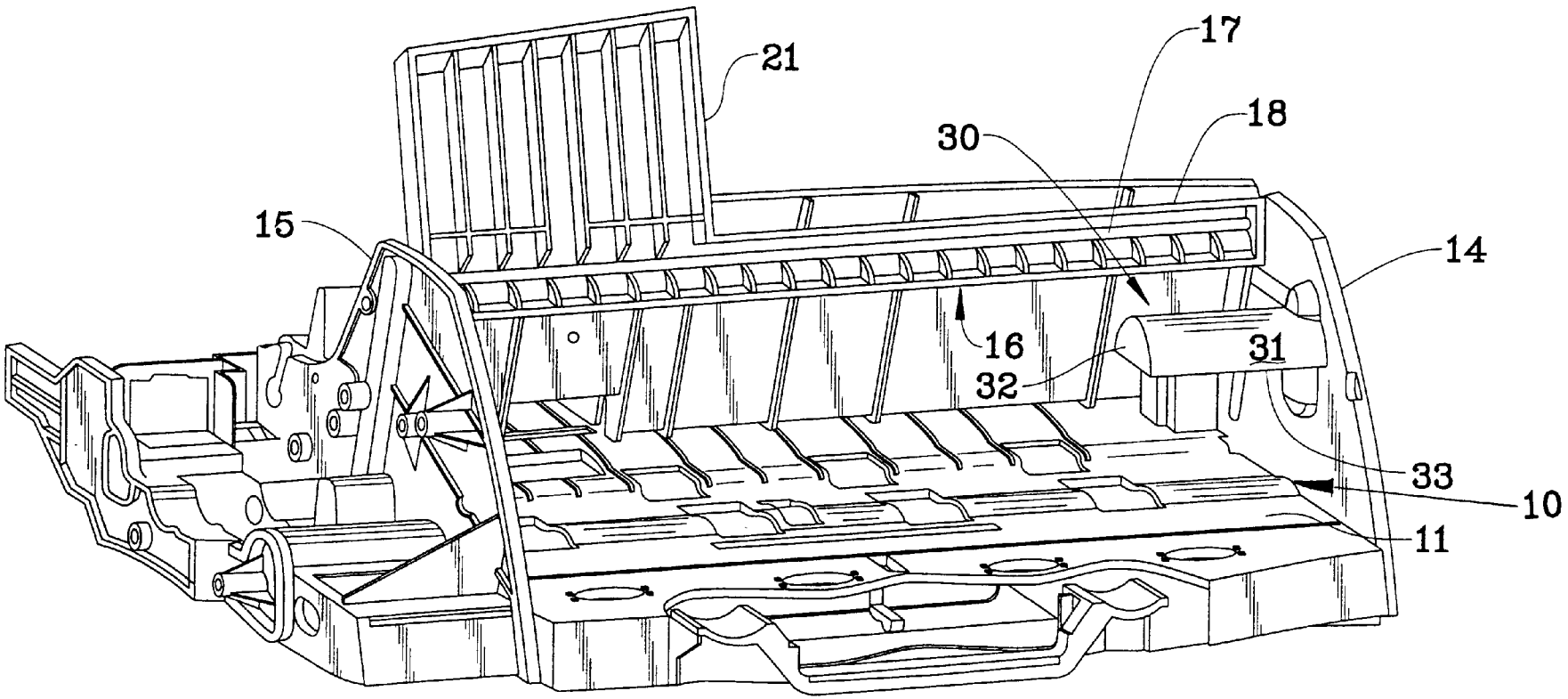
FIG. 1 is a front fragmentary perspective view of an envelope feeder having a movable weight of the present invention disposed in a raised or envelope loading position and a limiter for limiting the height of envelopes when the width of the envelopes exceeds a predetermined minimum.
Figure 2:
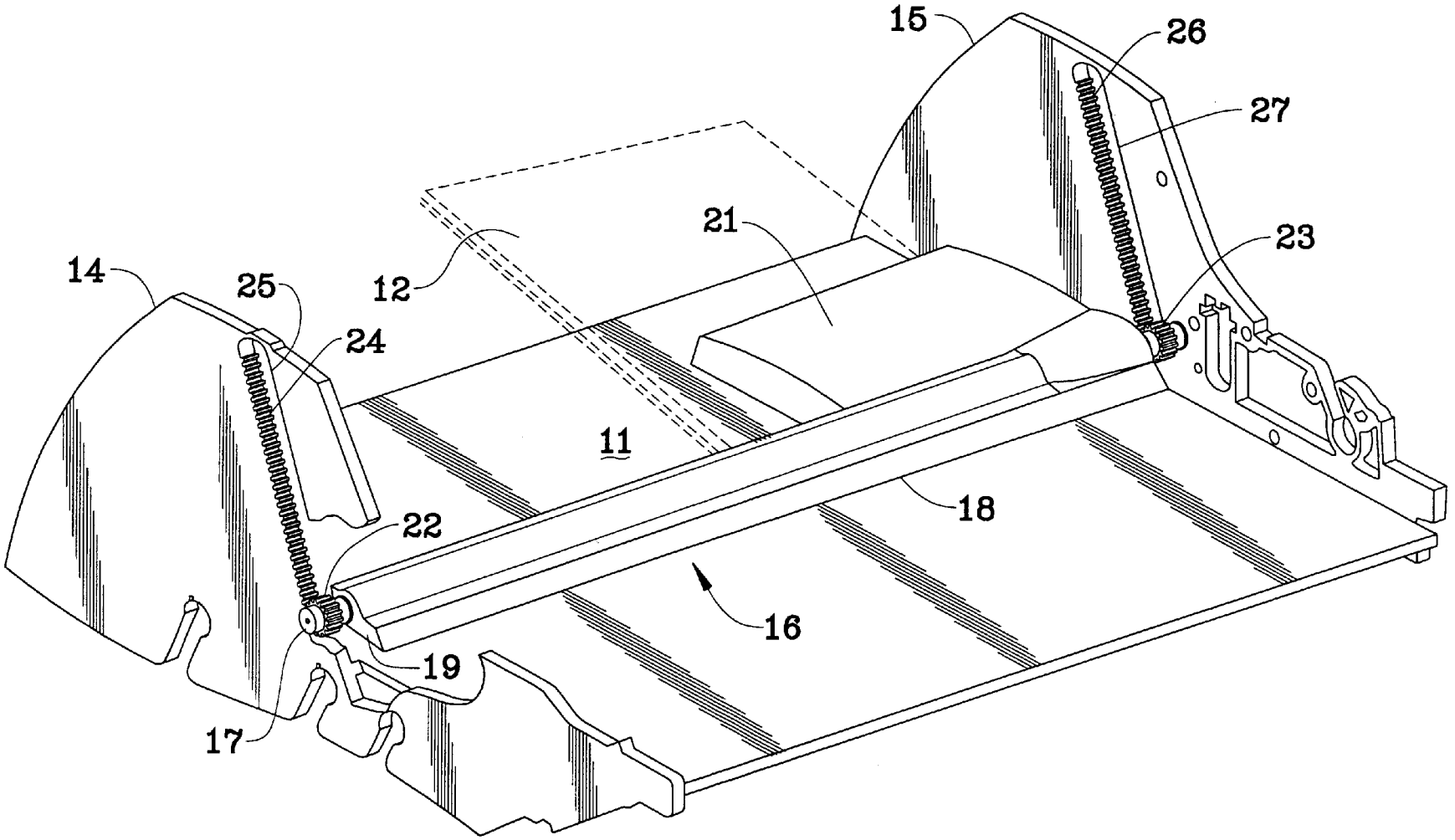
FIG. 2 is a rear perspective view of a portion of the envelope feeder of FIG. 1 with the movable weight in its envelope engaging position.

Referring to the drawings and particularly FIG. 1, there is shown an envelope feeder 10 including a floor 11 having a plurality of envelopes 12 (shown in phantom in FIG. 2) supported thereon. The floor 11 has a right side wall 14 extending upwardly therefrom and substantially perpendicular thereto. A left side wall 15, which is substantially parallel to the right side wall 14, extends upwardly from the floor 11 and substantially perpendicular thereto.

A movable weight 16 extends between the side walls 14 and 15. The movable weight 16 includes a rotatably mounted shaft 17 (see FIG. 1) attached to a longitudinal portion 18 of the movable weight 16 through an end wall 19 (see FIG. 3) of the longitudinal portion 18 and by gear 23 on shaft 17 being trapped in recess 27 (FIG. 2) adjacent the other end of the longitudinal portion 18. This allows pivotal movement of the movable weight 16 relative to the rotatably mounted shaft 17.

The longitudinal portion 18 of the movable weight 16 has a relatively large portion or area 21 at its end remote from the end wall 19. The relatively large portion or area 21 of the movable weight 16 is disposed adjacent the left side wall 15 when the movable weight 16 is in its envelope engaging position of FIG. 2.

The shaft 17 has a gear 22 mounted on its end extending beyond the end wall 19 and adjacent the right side wall 14 for rotation therewith. A gear 23 is mounted on the shaft 17 at its end extending beyond the longitudinal portion 18 and adjacent the left side wall 15 for rotation therewith.

The right side wall 14 has a rack 24 formed on one side of a slot 25 in the right side wall 14 through which the shaft 17 extends. The gear 22 meshes with the rack 24.

The left side wall 15 has a rack 26 along a wall of an elongated recess 27 in the left side wall 15. The gear 23 extends into the recess 27 to mesh with the rack 26.

Thus, the racks 24 and 26, which are parallel to each other, maintain the shaft 17 parallel to the floor 11 of the envelope feeder 10 during its up and down movement through the gears 22 and 23 meshing with the racks 24 and 26, respectively. This maintains the movable weight 16 against any skewing during up and down movement of the movable weight 16 along the racks 24 and 26.

Figure 3:
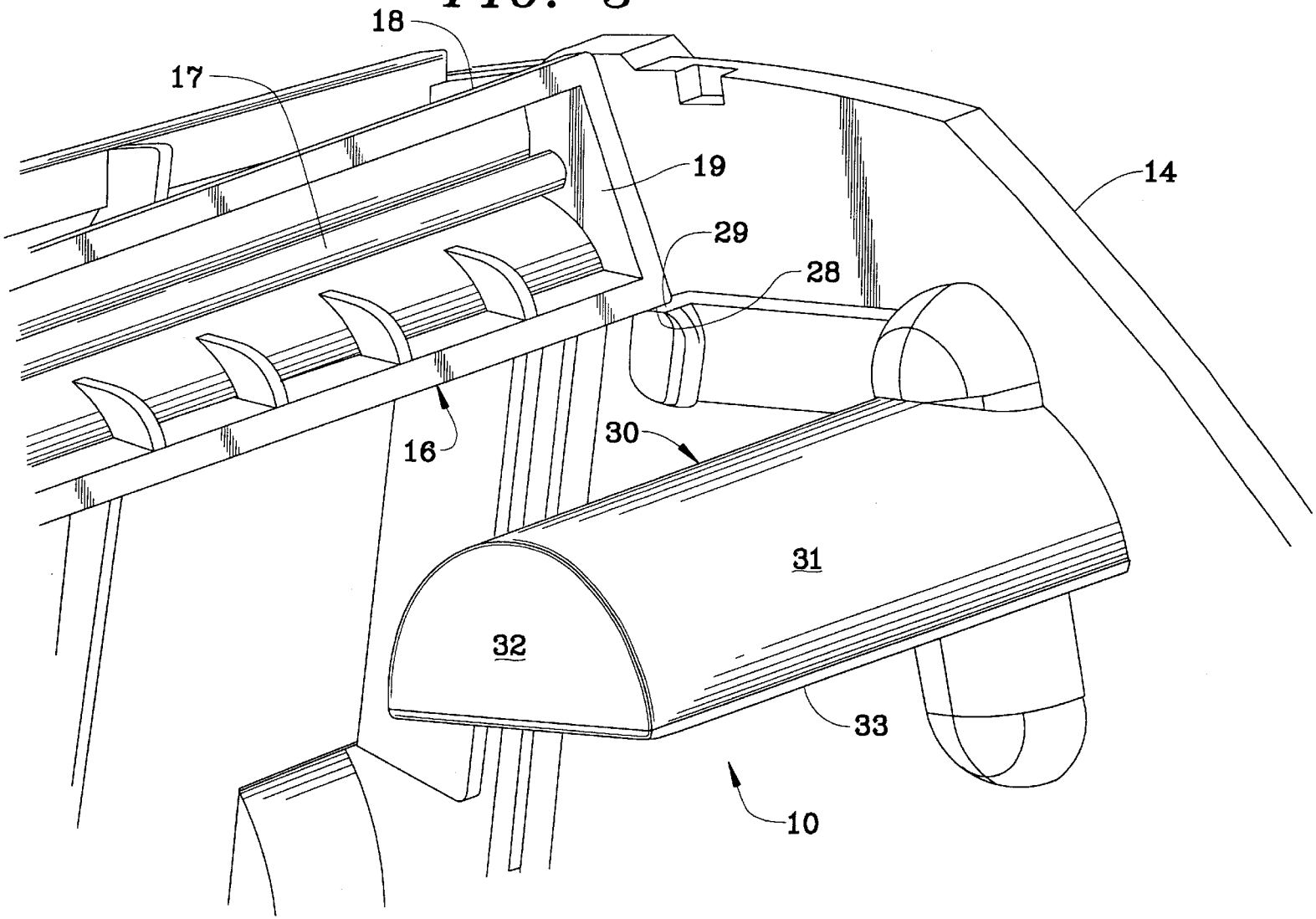
FIG. 3 is an enlarged front fragmentary perspective view of a portion of the envelope feeder of FIG. 1 and showing the movable weight held in its raised or envelope loading position.

When the envelopes 12 are loaded into the envelope feeder 10 for disposition on the floor 11, the movable weight 16 is moved to its uppermost position on the racks 24 and 26 and the movable weight 16 is pivoted about the shaft 17 to its envelope loading position of FIGS. 1 and 3. In this position, an edge 28 (see FIG. 3) of the movable weight 16 adjacent the end wall 19 rests on a ledge 29 on the interior surface of the right side wall 14. This engagement of the movable weight 16 with the ledge 29 holds the movable weight 16 in its upraised position of FIGS. 1 and 3 during loading of the envelopes 12 (see FIG. 2) on the floor 11 of the envelope feeder 10.

Figure 4:
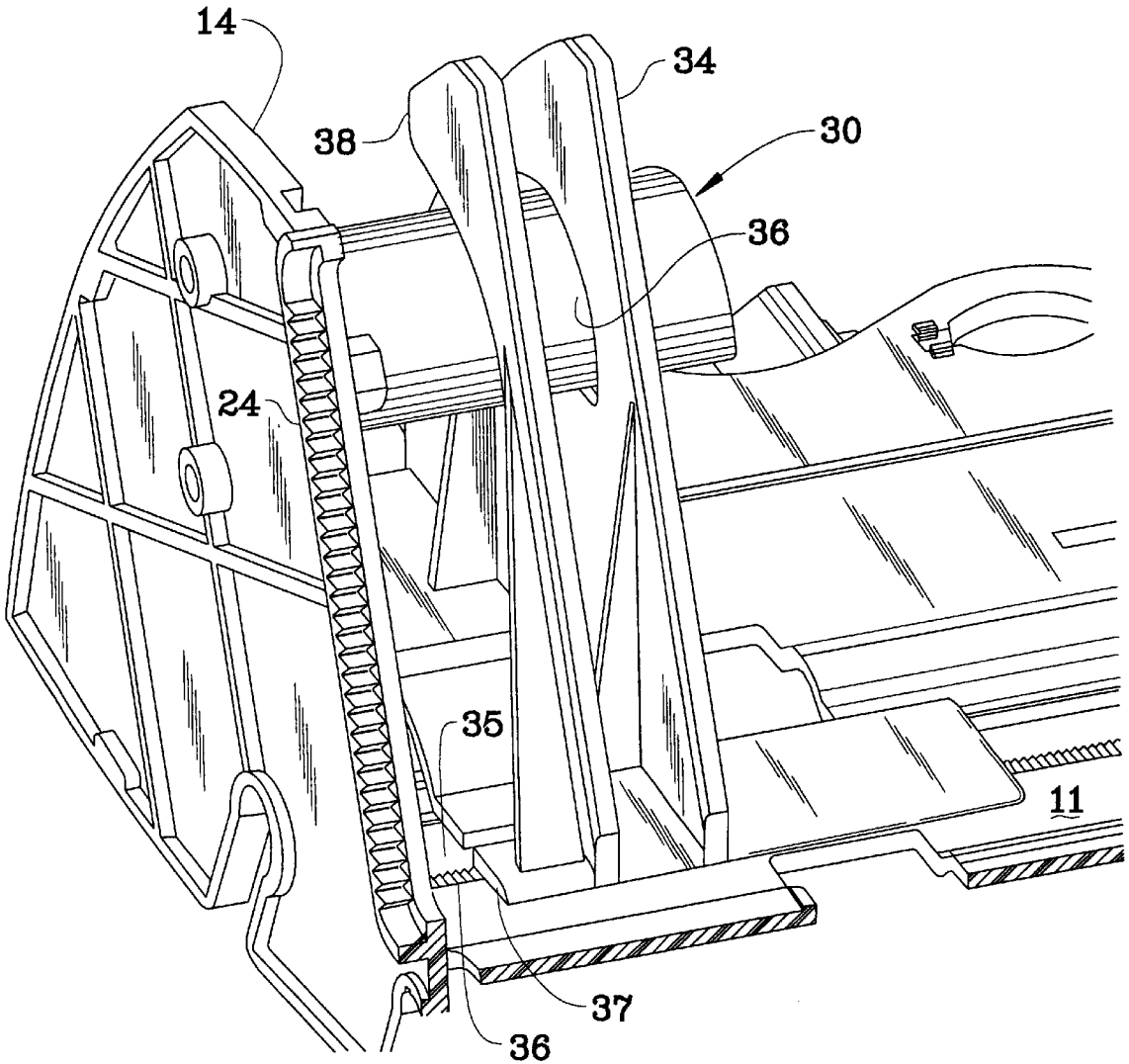
FIG. 4 is an enlarged rear fragmentary perspective, partly in section, view of a portion of the envelope feeder of FIG. 1 and showing a slide for engaging the right edges of the envelopes to hold them against a left side wall of the envelope feeder.

The right edge of the envelopes 12 abuts a slide 34 (FIG. 4). The slide maintains the left edge of the envelopes 12 against the inner surface of the left side wall 15.

The right side wall 14 (see FIG. 3) has an envelope limiter 30 extending from its inner surface substantially perpendicular thereto. The limiter 30 has a hollow semicircular portion 31 with a semicircular end portion 32. Terminal end surfaces 33 (one shown in FIG. 1) of the hollow semicircular portion 31 are substantially parallel to each other and to the floor 11. Thus, the terminal end surfaces 33 of the hollow semicircular portion 31 are substantially parallel to each other and are substantially parallel to the floor 11 of the envelope feeder 10.

Accordingly, the terminal end surfaces 33 of the hollow semicircular portion 31 engage the uppermost of the envelopes 12 (see FIG. 2) in a stack of the envelopes 12 when the width of the envelopes 12 is sufficient to extend from the inner surface of the left side wall 15 to beneath the limiter 30 (see FIG. 3). Therefore, the limiter 30 limits the maximum height of a stack of the envelopes 12 (see FIG. 2) when they exceed a width greater than the distance from the inner surface of the left side wall 15 to the limiter 30 (see FIG. 3). This insures that the power of the motor advancing the envelopes 12 (see FIG. 2) from the bottom of the stack will not be exceeded.

An envelope engaging slide 34 (see FIG. 4) engages the right side edge of the envelopes 12 (see FIG. 2) to hold the envelopes 12 against the inner surface of the left side wall 15. The slide 34 (see FIG. 4) rides in a slot 35 in the floor 11 with the slot 35 limiting the movement of the slide 34 towards the left side wall 15 (see FIG. 2).

The slide 34 (see FIG. 4) must be capable of moving beyond the semicircular end 32 (see FIG. 3) of the limiter 30 towards the right side wall 14. Thus, the slide 34 (see FIG. 4) would have an opening 36 to receive the limiter 30 in the motion of the slide 34 towards the right side wall 14. This is because the slide 34 must be higher than the limiter 30 when the envelopes 12 (see FIG. 2) are not as wide as the distance from the inner surface of the left side wall 15 to the semicircular end 32 (see FIG. 3) of the limiter 30.

The slide 34 (see FIG. 4) must be retained in any position to which it is moved along the slot 35. Accordingly, the floor 11 has transverse teeth 36, which comprise a rack, adjacent one edge of the slot 35 for cooperation with a downwardly projecting pawl 37 of the slide 34 to hold the slide 34 against movement. To move the slide 34, the downwardly projecting pawl 37 is removed from engagement with one of the teeth 36 through pushing an upwardly extending arm 38 towards the left side wall 15 (see FIG. 3).

It should be understood that the envelope feeder 10 may have any suitable drive mechanism. It is preferred to use the drive mechanism of our copending application entitled "ENVELOPE FEEDER," Ser. No. 08/852,370, filed the same day this application was filed (Lexmark Docket LE9-97-050), which is incorporated by reference herein.

An advantage of this invention is that a movable weight can be constrained to always be disposed substantially parallel to the floor of an envelope feeder when the movable weight is engaging the top of a stack of envelopes. Another advantage of this invention is that the constrained weight is pivotable so that it contacts the highest point of the top envelope in a stack so as to apply force thereto to move the high point down if necessary. A further advantage of this invention is that the height of a stack of envelopes is limited when the envelopes exceed a predetermined minimum width so that the power of the envelope advancing motor is not exceeded by the weight of the envelopes in the stack.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

What is claimed is:

1. An envelope feeder for feeding a lowermost envelope from a stack of envelopes including:

a floor for supporting a stack of envelopes for feeding the lowermost envelope from said stack of envelopes;

first and second substantially parallel side walls extending upwardly from said floor and substantially perpendicular thereto each said side walls having a rack extending away from said floor;

a shaft extending between said side walls having a first end and a second end;

a first gear mounted for rotation with said shaft at said first end of said shaft, said first gear meshing with said rack of said first parallel side wall;

a second gear mounted for rotation with said shaft at said second end of said shaft, said second gear meshing with said rack of said second parallel side wall;

a movable weight supported between said first and second substantially parallel side walls by said shaft extending through said movable weight to allow said weight to pivot relative to said shaft for a disposition on top of the stack of envelopes supported on said floor;

said shaft maintaining said movable weight substantially parallel to said floor at any position of said movable weight on top of the stack of envelopes while said weight is free to pivot around said shaft.

2. The envelope feeder according to claim 1 including limit means extending from only one of said first and second substantially parallel side walls substantially perpendicular thereto for a predetermined distance over said floor for limiting the height of any stack of envelopes of a width sufficient to extend beneath said limit means from the other of said first and second substantially parallel side walls, said limit means including means disposed substantially parallel to said floor for engaging the top envelope in any stack of envelopes of a width sufficient to extend beneath said limit means.

3. The envelope feeder according to claim 2 in which said movable weight has a larger surface area engaging the stack of envelopes in an area spaced from said one of said first and second substantially parallel side walls, said larger surface area of said movable weight being spaced from said limit means.

4. The envelope feeder according to claim 3 including support means on said one side wall of said first and second substantially parallel side walls for supporting said movable weight in a raised and inoperative position when said movable weight is pivoted about said shaft from its envelope engaging position.

* * * * *